United States Patent [19]

Bastenhof

[11] Patent Number: 4,515,500

[45] Date of Patent: May 7, 1985

[54] COMBUSTION POWERED WAVE GENERATOR

[75] Inventor: Dirk Bastenhof, Langerak, Netherlands

[73] Assignee: Ecopool Design Limited, Channel Islands, Channel Islands

[21] Appl. No.: 551,951

[22] Filed: Nov. 15, 1983

[51] Int. Cl.[3] ..... E04H 3/16; F04D 35/00

[52] U.S. Cl. ..... 405/79; 4/491; 60/516; 405/52; 417/73

[58] Field of Search ..... 405/79, 52; 4/491, 492; 60/516; 417/73, 74

[56] References Cited

U.S. PATENT DOCUMENTS

| | | | |
|---|---|---|---|
| 398,659 | 2/1889 | Secor | 417/73 X |
| 1,219,867 | 3/1917 | Reilly | 417/73 |
| 1,237,688 | 8/1917 | Ostenberg | 417/73 |
| 1,750,229 | 3/1930 | Lasmolles | 417/73 |
| 2,056,855 | 10/1936 | Herz | 405/79 X |
| 2,532,635 | 12/1950 | Miller | 417/73 |
| 3,044,252 | 7/1962 | Zwicky | 417/73 X |
| 3,350,724 | 11/1967 | Leigh | 4/491 |
| 3,629,877 | 12/1971 | Schuster | 4/491 |

FOREIGN PATENT DOCUMENTS

| | | |
|---|---|---|
| 1684954 | 11/1971 | Fed. Rep. of Germany . |
| 709686 | 5/1931 | France . |
| 942140 | 9/1948 | France . |
| 209878 | 9/1907 | German Democratic Rep. . |
| 101979 | 7/1962 | Netherlands . |
| 161548 | 2/1980 | Netherlands . |
| 163218 | 10/1933 | Switzerland . |

OTHER PUBLICATIONS

German Publication: "Archiv. des Badewesens" Apr. 1966.

German Publication: "Piscines nr. 17" Oct./Nov. 1969.

*Primary Examiner*—Dennis L. Taylor

*Attorney, Agent, or Firm*—Weingarten, Schurgin Gagnebin & Hayes

[57] ABSTRACT

A wave generator for a swimming pool, comprising a caisson divided into a plurality of wave-generating chambers. Each wave-generating chamber communicates with the swimming pool through a below-the-water passage and has a sealed portion which extends above the water level of the pool. Each sealed portion of the chamber receives combustive elements which are ignited to produce an increased pressure which directly displaces the water within the chamber, inducing a wave action in the associated swimming pool. Each wave-generating chamber is selectively operated in concert with the remaining chambers to produce a desired wave pattern which propagates across the pool surface. The present wave generator features increased efficiency and fewer components over previous wave-generating apparatus.

14 Claims, 4 Drawing Figures

COMBUSTION POWERED WAVE GENERATOR

FIELD OF THE INVENTION

The present invention relates to a pneumatic wave generator, and in particular a combustion-powered artificial wave generator for use with a swimming pool.

BACKGROUND OF THE INVENTION

Artificial wave generators used to produce waves in a swimming pool have been known to comprise a caisson having a plurality of wave-generating chambers, where each chamber communicates with the swimming pool through an underwater passage, and a sealed portion which extends above the water level of the swimming pool. The waves are typically created by selective application of a positive air pressure to one or more generating chambers at preselected intervals through a system of mechanical valves and system ducts. The generator of this type is typically powered by a pressure source driven by an electric motor. In operation, such systems continuously maintain an air pressure and vent the air pressure into the selected chambers when the water reaches the highest level for maximum efficiency. However, the system requires a source of pressure having a very high capacity and pressure head. Efficiency is lost in the generation of the pressure from an electric motor, and in the system of ducts and valves to transport the volume of air to the selected chamber. Additionally, air-powered generators having blower systems typically require significant floor space for the compressor and the associated apparatus, and produce significant noise and vibration.

SUMMARY OF THE INVENTION

The present invention provides a wave-generating system of high efficiency by displacing water directly through a combustion process. The present invention includes a plurality of enclosed chambers within the caisson, wherein a mixture of gas and air is injected into the space above the water level of the chamber. The combustive mixture within each chamber is selectively ignited according to a predetermined manner to produce a desired wave condition to propagate over the pool surface. The wave parameters are controlled by the amount of water displaced per unit time, the choice of fuel, and the extent and velocity of combustion. The combustion process can be controlled sufficiently to maintain a clean and complete combustion such that the combustion products do not pollute the water. In addition, the wave-generating means according to the present invention require no additional floor space, and are easy to control to produce the desired wave. Also, the chambers may be of smaller dimension, to produce a more silent operation than conventional pneumatic wave generators. Also, the resulting heat from the combustion process is utilized for heating of the surrounding environment.

BRIEF DESCRIPTION OF THE DRAWING

These and other features of the present invention are better understood by reading the following, solely exemplary, detailed description along with the drawing wherein.

DETAILED DESCRIPTION OF THE INVENTION

Figure 1:
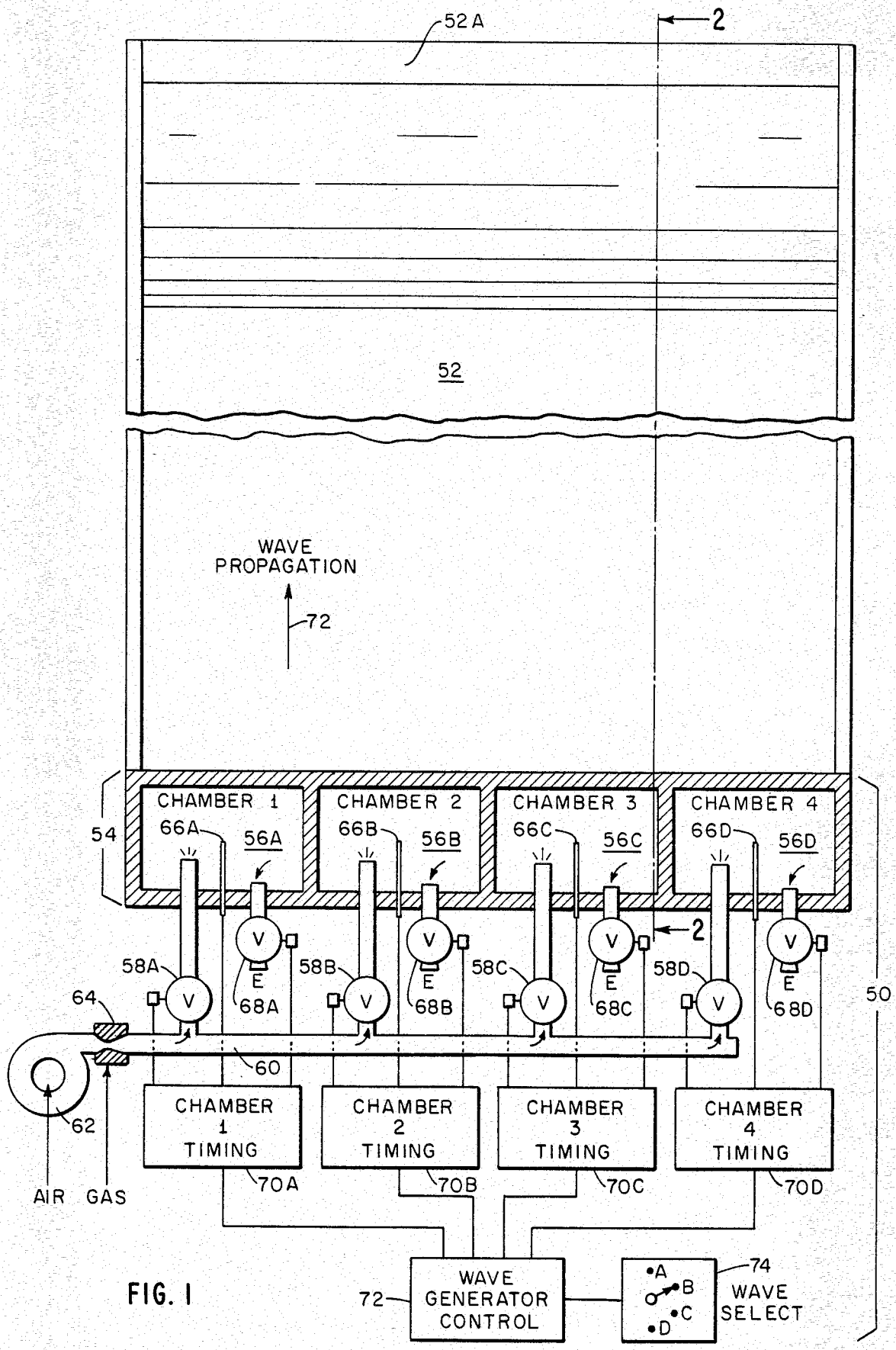
FIG. 1 is a block diagram of one embodiment of the combustion-powered system according to the present invention.
Figure 2:
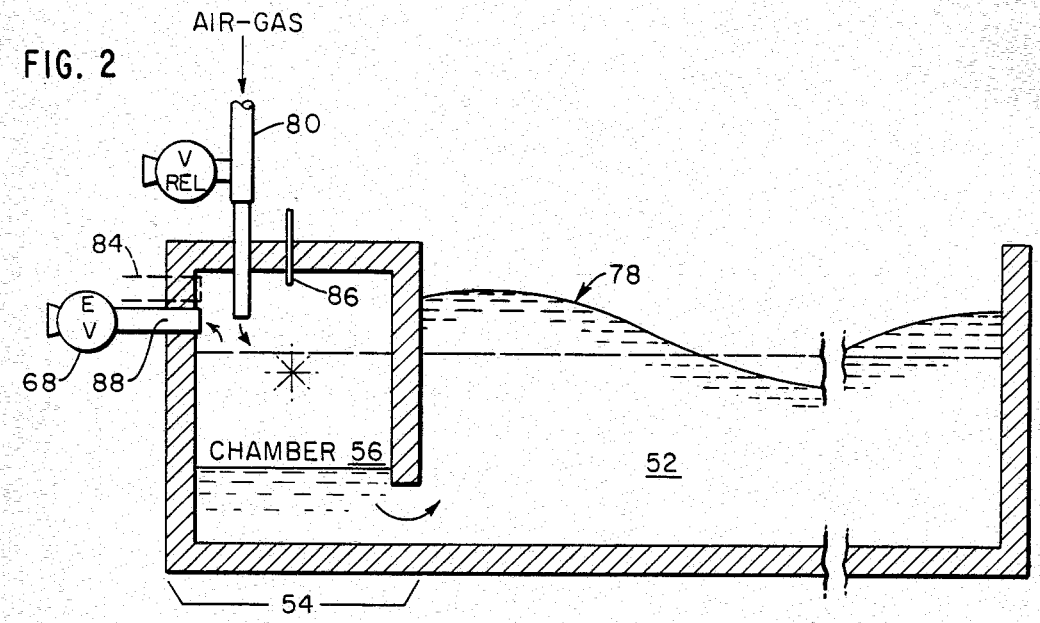
FIG. 2 is a longitudinal sectional view of FIG. 1.
Figure 4:
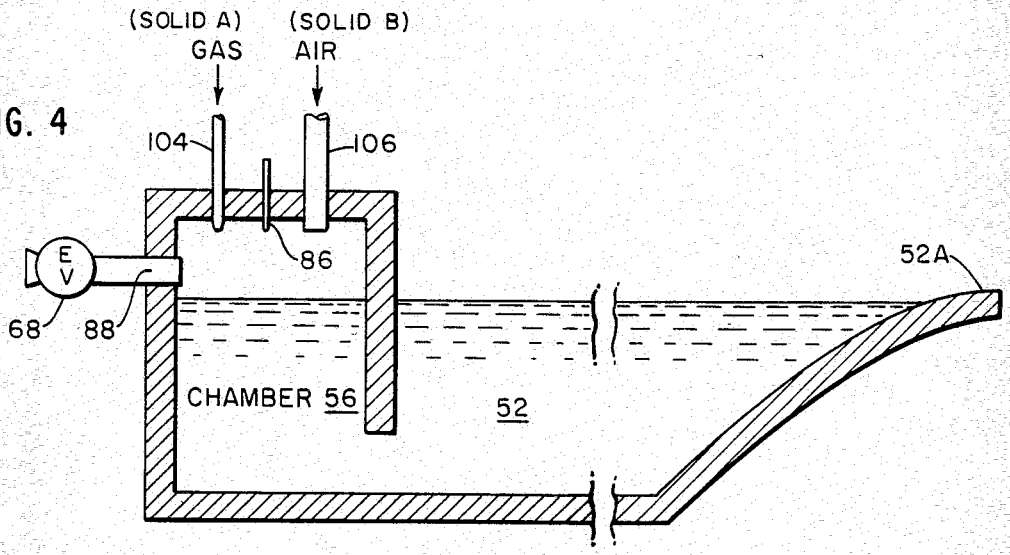
FIG. 4 is an alternate sectional view of FIG. 1.

The diagram of FIG. 1 and associated sectional views shown in FIGS. 2 and 4 show the relationship of chambers 54 of the combustion-powered wave generating system 50 to the swimming pool 52. In this exemplary embodiment, the caisson 54 comprises four chambers 56A, 56B, 56C, and 56D; alternately, the wave-generating system according to the present invention may include a different number of chambers. Each chamber receives a metered amount of combustion elements according to valves 58A, 58B, 58C, and 58D, respectively, from a fuel supply column 60. The fuel supply column is provided by a mixture of combustion elements, such as air and gas. The particular embodiment shows a compressed air source 62, typically comprising an air compressor providing a column of air through a venturi-metering device 64, which receives a flow of gas, such as natural gas, to be drawn into the air column provided by the compressor 62 in a manner related to the velocity and volume thereof, according to techniques well known. After the combustion mixture is introduced into each respective chamber, the mixture is selectively ignited by spark devices 66A, 66B, 66C, and 66D, respectively. Upon combustion, the expanding gases displace the water within each respective chamber into the remaining area of the swimming pool 52, to contribute to the formation of a desired wave to flow away from the caisson 54. After the combustion is complete, the exhaust valves 68A, 68B, 68C, and 68D, are selectively operated to allow the expanded gases to escape from each selected chamber, which in turn permits the displaced water to return. The operation of each metering valve, spark device, and exhaust valve means are controlled by respective chamber timing units 70A, 70B, 70C, and 70D to allow the chamber to be controlled in a manner to produce maximum wave generation, complete and clean combustion, and repeatable performance, according to known combustion techniques, not discussed here. Such combustion processes include a 2-cycle and 4-cycle combustion process, commonly known in the art of combustion engines.

Each particular chamber timing unit is in turn controlled by a wave control generator 72 which produces a predetermined wave according to a selected wave by the selection unit 74 to produce a wave propagation 76 towards the far end or beach area 52A of the swimming pool 52. For efficiency and wave control, the preferred embodiment includes chambers having a cross-sectional opening to the swimming pool of approximately one-quarter wave length of the propagated wave; however, the present invention is not limited to the quarter-wave specification, and other relative opening dimensions may be provided as desired. The combustion action in any one or more chambers can be provided in a particular sequence to form a desired wave pattern according to wave generation techniques known in the art and not discussed here.

The sectional view in FIG. 2 shows the wave 78 propagating across the surface water of the pool 52. The chamber 56 of the caisson 54 receives a mixture of air and gas via an inlet 80 from a metered source, shown typically in FIG. 3. A pressure relief valve 82 provides a measure of safety should the combustion process provide an excessive pressure within the chamber 56. Alternately, the mixture may be introduced horizontally 84 as shown in phantom; additional means and methods of introducing the premixed combustion elements are possible. The products are ignited by a spark device 86, typically a spark plug or variant thereof, causing the mixture within chamber to ignite, forming an expanded gas mass to displace the water contained therein downward and into the body of the pool 52, thus forming the leading edge of the wave 78. After combustion is complete, the combustion gases are exhausted to the atmosphere through the exhaust port 88 according to the operation of the exhaust valve 58.

Figure 3:
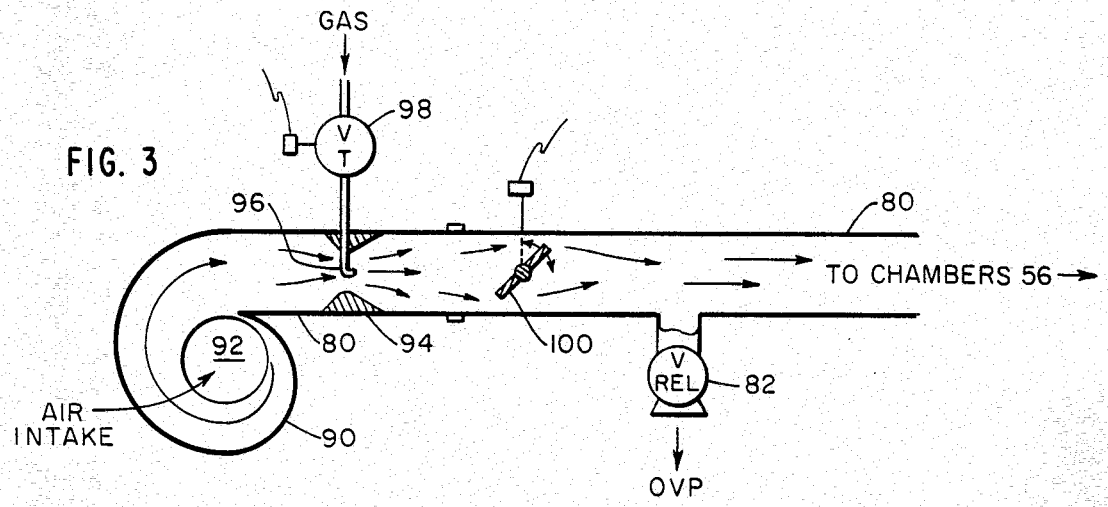
FIG. 3 is a diagrammatic view of one method of introducing the combustion elements.

The mixture of air and gas comprising the mixed combustion components is shown according to the system elements of FIG. 3. The chamber fuel feed line 80 is driven by a blower 90 having an air intake 92 to provide a volume of air at a predetermined pressure at the beginning of the chamber supply line 80. The air flow passes through a venturi-metering restriction 94 wherein a gas flow is received through a gas jet 96 whose flow is metered by a throttle valve 98. The air flow, now containing a volume of gas, flows through a variable valve 100, adjusted to meter the amount of combustion elements to each selected chamber. A relief valve 82 is included to allow excessive pressure to escape without flowing backward into the upper end of the column 80, disrupting the operation of the chambers.

An alternate method of introducing the combustion elements into the chamber 56 is shown in the sectional view of FIG. 4. In this embodiment, the particular combustion elements, such as gas and air, introduced by separate inlets or injectors 104 and 106, respectively. The combustion products may also include solid or liquid elements, commonly found in rocket propellants or other known uses for combustion elements. According to the present embodiment shown in FIG. 4, the mixture of the combustion products occurs within the air space of the chamber 56 above the water. After combustion ignited by spark means 86, the exhaust gases are vented through the exhaust port 88 and exhaust valve 58 to the outside atmosphere, in a commonly known manner.

The above, solely exemplary, embodiments are not to be construed as limiting the scope of the present invention. Variations, alterations, and substitutions of various elements and substances thereof according to the knowledge of one skilled in the art is within the scope of the present invention. Accordingly, the present invention is not limited except by the following claims.

What is claimed is:

1. A wave generator system for generating waves in a swimming pool comprising:

at least one chamber communicative with said swimming pool through a below-the-water passage and having a sealed portion extending above the water level of said pool, each chamber comprising:

means for selectively introducing combustive elements into said chamber; and means for selectively igniting said combustive elements within said chamber according to the waves to be generated.

2. The wave generating system of claim 1 wherein said combustive elements comprise natural gas and air.

3. The wave generating system of claim 1 wherein at least two of said combustive elements are premixed before introduction into the chamber.

4. The wave generating system of claim 3 wherein said means for introducing includes a compressor and a venturi metering means.

5. The wave generating system of claim 1 wherein said means for introducing comprises at least one fuel injection means to inject at least one of said combustive elements directly into said chamber.

6. The wave generating system of claim 1 wherein said combustive elements include at least one solid fuel element.

7. The wave generating system of claim 1, wherein said means for igniting comprises spark means.

8. The wave generating system of claim 7, wherein said means for igniting includes timing means to cause ignition at selected time intervals.

9. The wave generating system of claim 8, further including means for venting combustion products from the chamber.

10. The wave generating system of claim 9, wherein the means for venting is selectably operated according to a desired wave rhythm and height.

11. The wave generating system of claim 9, wherein said timing means further controls said means for introducing and said means for venting.

12. The wave generating system of claim 11, wherein said chamber is operated according to a two-cycle combustion process.

13. The wave generating system of claim 11, wherein said chamber is operated according to a four-cycle combustion process.

14. The wave generating system of claim 1, further including means for selectively sequencing each of said chambers to act in concert to produce a desired wave within said pool.

* * * * *

UNITED STATES PATENT AND TRADEMARK OFFICE

CERTIFICATE OF CORRECTION

PATENT NO. : 4,515,500

DATED : May 7, 1985

INVENTOR(S) : Dirk Bastenhof

It is certified that error appears in the above-identified patent and that said Letters Patent is hereby corrected as shown below:

Title page

Line [73] Assignee: "Ecopool Design Limited, Channel Islands, Channel Islands" should read --Ecopool Design Limited, Channel Islands, Great Britain--

Signed and Sealed this

*Eighth* Day of *July 1986*

[SEAL]

*Attest:*

DONALD J. QUIGG

*Attesting Officer*

*Commissioner of Patents and Trademarks*